US010182687B2

(12) United States Patent
Gwen

(10) Patent No.: US 10,182,687 B2
(45) Date of Patent: Jan. 22, 2019

(54) SPLASHGUARD FOR PLUNGING A TOILET

(71) Applicant: Patrick Gwen, Houston, TX (US)

(72) Inventor: Patrick Gwen, Houston, TX (US)

( * ) Notice: Subject to any disclaimer, the term of this patent is extended or adjusted under 35 U.S.C. 154(b) by 3 days.

(21) Appl. No.: 15/436,398

(22) Filed: Feb. 17, 2017

(65) Prior Publication Data

US 2018/0238034 A1 Aug. 23, 2018

(51) Int. Cl.
*A47K 11/10* (2006.01)

(52) U.S. Cl.
CPC ..... *A47K 11/105* (2013.01); *A47K 11/10* (2013.01)

(58) Field of Classification Search
CPC ..... A47K 11/10; A47K 11/105; A47K 13/14
USPC ..... 4/245.1–245.9, 239, 300.3, 253, 255.11, 4/255.04; 493/395, 397, 399, 405, 453, 493/463
See application file for complete search history.

(56) References Cited

U.S. PATENT DOCUMENTS 1,313,236 A * 8/1919 Mason ..... A47K 13/16 4/245.3
1,761,391 A * 6/1930 Harris ..... A47K 13/16 4/245.3
2,160,221 A * 5/1939 Masters ..... B65D 5/5033 156/207
2,548,238 A * 4/1951 Potts ..... A47K 13/06 297/250.1
2,575,236 A * 11/1951 Slawson ..... A47K 3/001 4/580
2,825,070 A * 3/1958 Zareh ..... A47K 13/06 4/239
4,831,669 A 5/1989 Edwards
5,706,528 A 1/1998 Broback
6,473,911 B2 * 11/2002 Weiss ..... A47K 13/06 4/239
6,594,831 B1 7/2003 Pardo et al.
6,968,578 B2 * 11/2005 Bernsley ..... A47K 13/06 4/235
6,996,860 B1 * 2/2006 Blake ..... A47K 3/001 4/498
7,310,831 B2 12/2007 Duvall et al.
7,749,588 B2 * 7/2010 Blake ..... A47K 13/14 428/77
2010/0000010 A1 1/2010 Martinisko
2012/0042443 A1 * 2/2012 Aguila ..... A47K 13/06 4/245.6

* cited by examiner

*Primary Examiner* — Erin Deery
(74) *Attorney, Agent, or Firm* — Craft Chu PLLC; Andrew W. Chu

(57) ABSTRACT

The splash guard for plunging a toilet includes a corrugated panel having a top layer and a bottom layer. There is a first portion with first flaps and a second portion with second flaps, respectively. The front side of the first portion is hinged to the back side of the second portion by either the top layer or the bottom layer. The corrugated panel has a first configuration with the first portion folded to the second portion with the first and second flaps locked in position relative to each other and a second configuration with the first portion flush or coplanar to the second portion with the first and second flaps folded downward. The first portion is locked in position relative to the second portion by the first and second flaps in the second configuration. The corrugated panel is placed to cover a toilet bowl in the second configuration.

15 Claims, 3 Drawing Sheets

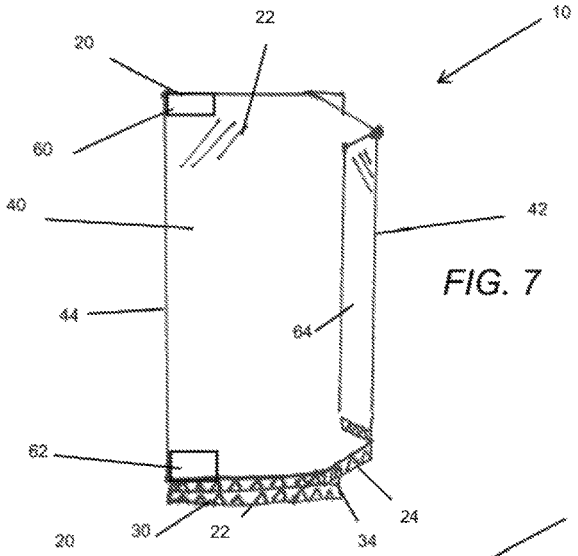
FIG. 7
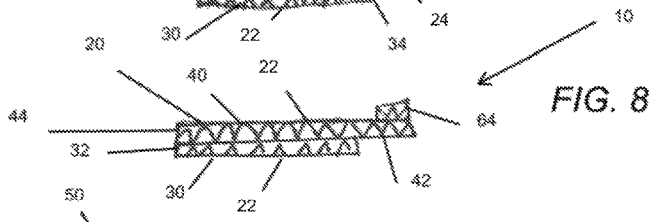
FIG. 8
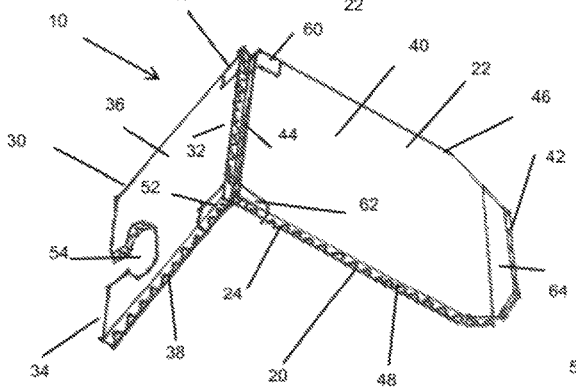
FIG. 9
FIG. 10
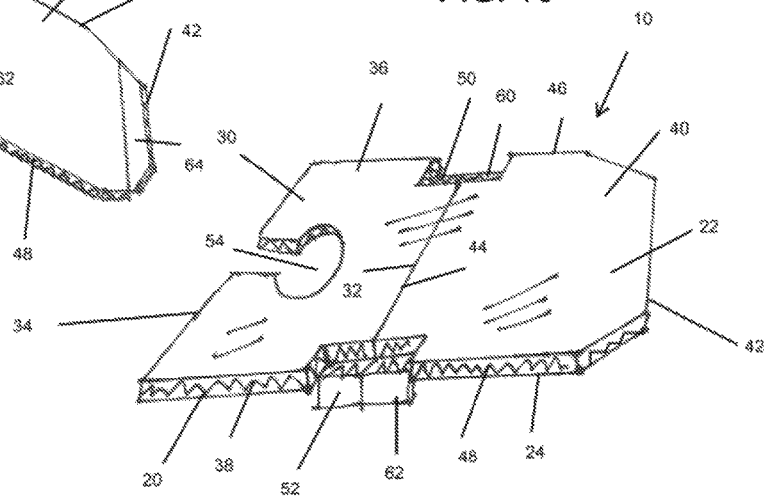

SPLASHGUARD FOR PLUNGING A TOILET

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to device for sanitation. More particularly, the present invention relates to a device to prevent toilet water from splashing out of a toilet bowl. Even more particularly, the present invention relates to a splash guard for plunging a toilet.

2. Description of Related Art Including Information Disclosed Under 37 CFR 1.97 and 37 CFR 1.98

A toilet plunger unclogs blockages in a toilet bowl. The use of a typical toilet plunger displaces the water in the toilet bowl, and that water may contain sewage and other debris. Especially with particularly vigorous use of the toilet plunger for difficult blockages, the sloshing and splashing of the water raises health and sanitation concerns.

Several patents and patent publications have addressed the need to retain the water in the toilet bowl when plunging a toilet.

U.S. Pat. No. 4,831,669, issued to Edwards on 23 May 1989, describes a plunger splash guard for a toilet bowl. The splash guard is a flexible panel covering the opening of the toilet bowl. There is a hole in the panel so that the handle of the plunger can extend through the panel. The plunger can move up and down within the toilet bowl to unclog the blockage as the handle passes back and forth through the hole.

U.S. Pat. No. 5,706,528, issued to Broback on 13 Jan. 1998, discloses another splash guard for covering the opening of the toilet bowl. This splash guard is a panel with a hole, and the handle passes through the hole when plunging. The panel has rigid portion for covering the toilet bowl, and a series of ridges and indentations of flexible materials concentrically arranged around the hole. The splash guard has different rings with different flexibility.

U.S. Pat. No. 7,310,831, issued to Duvall et al on 25 Dec. 2007, is a disposable protector including a frame, a handle, and a shield. The handle latches to the rim of the toilet bowl, and the shield is mounted on the frame so as to cover the opening of the toilet bowl. A hole in the shield allows the handle of a plunger to pass back and forth through the shield.

US Patent Publication No. 20100000010, published for Martinisko on 7 Jan. 2010, teaches another shield to prevent water from splashing from a toilet bowl. There is a shield body to cover the opening of the toilet bowl with various attachment means, such as straps and adhesive. A hole in the shield body allows for a plunger to pass through the shield body when aligned with the drain opening of the toilet.

U.S. Pat. No. 6,594,831, issued to Pardo et al on 22 Jul. 2003, teaches a different type of splash guard as a cover sheet for the opening of the toilet bowl and the plunger. The handle of the plunger can be grasped by grasping the cover sheet around the handle. The user only touches the outside of the cover sheet, not the actual handle. The cover sheet is baggy and flexible for moving the handle underneath the cover sheet.

In the prior art, the rigid shields and splash guards cannot be stored or transported easily. The shields and splash guards must be large enough to cover the opening of the toilet bowl, so this size requirement prevents easy and convenient storage before use. Additionally, there is no size adjustment for different toilet bowls. The rigid shields and splash guards are not adjustable, so that a different splash guard would be required for each toilet bowl size.

It is an object of the present invention to provide a splash guard that is rigid in an operating configuration and folded in a storage configuration.

It is another object of the present invention to provide a splash guard that is collapsible.

It is another object of the present invention to provide a splash guard that can be locked rigid in the operating configuration.

It is still another object of the present invention to provide a splash guard with side flaps to lock the panel in the operating configuration.

It is an object of the present invention to provide a splash guard that can have an adjustable hole for passing through different handles of different plungers.

It is an object of the present invention to provide a splash guard that is adjustable for different toilet bowls.

It is another object of the present invention to provide a splash guard with an end flap to shorten the splash guard for different toilet bowls.

It is another object of the present invention to provide a splash guard made from corrugated materials having a first layer and a second layer.

It is still another object of the present invention to provide a splash guard with side flaps hinged at the first layer for the rigid operating configuration and panels hinged at the second layer for the collapsed storage configuration.

These and other objectives and advantages of the present invention will become apparent from a reading of the attached specification.

BRIEF SUMMARY OF THE INVENTION

Embodiments of the present invention include a splash guard for plunging a toilet. The splash guard has unitary construction and multiple configurations for easier storage and efficient transformation into an operating configuration.

The splash guard is comprised of a corrugated panel having a top layer and a bottom layer. The corrugated panel is defined by a first portion having a first front side, a first back side, and two first opposing sides and a second portion having a second front side, a second back side, and two second opposing sides. Each of the portions is comprised of a corresponding plurality of first flaps and second flaps. Each flap is positioned on the respective opposing sides of first portion and the second portion. Each flap is in hinged attachment by the bottom layer, and the first front side is hinged to the second back side.

In the present invention, the corrugated panel has a first configuration with the first portion folded to the second portion along the hinged attachment of the first front side and the second back side. The hinged attachment can be by the bottom layer or by the top layer. The first and second flaps in the first configuration are locked in position relative to each other. The corrugated panel also has a second configuration with the first portion flush or co-planar with the second portion and each flap being folded downward from the top layer of the first portion along the hinged attachment of each flap. The first portion is locked in position relative to the second portion by the first flaps and the second flaps. In the second configuration, the corrugated panel can fit within the toilet bowl. The flaps extend into the rim of the bowl, and the first and second portions cover the toilet bowl.

Embodiments further include the first portion being comprised of an opening or hole. In some embodiments, the opening extends from the first back side toward the first front side, and the opening can be comprised of a centered portion and an extension portion. The centered portion is in the middle of the first portion and can have a plurality of hole flaps around the centered portion. The hole flaps can be hinged to enlarge the opening during plunging.

Other embodiments include the second portion being comprised of a tip portion in hinged attachment to the second front side. The tip portion can elongate the corrugated panel to over a larger toilet bowl, while also remaining collapsible for convenient storage. The tip portion can hinge on either the top layer or the bottom layer, depending upon the hinged relationship between the first portion and the second portion.

Embodiments of the present invention include the method for plunging a toilet bowl by assembling the corrugated panel with the first and second configurations. The corrugated panel is initially set in the first configuration as a storage configuration. A plunger is set in a toilet bowl, and the handle end of the plunger extends out of the toilet bowl. The corrugated panel switches from the first configuration to the second configuration, and the handle end is inserting through the corrugated panel in the second configuration. Then, the plunger can be actuated through the corrugated panel so as to unclog the toilet bowl. In embodiments with an opening in the first portion, the handle end aligns with the opening so that the handle end inserts through the opening. In further embodiments, the opening may have hole flaps to enlarge the opening in the second configuration. In embodiments with a tip portion of the second portion, the first configuration includes the tip portion folded to the second portion, and the second configuration includes the tip portion unfolded from the second portion so as to enlarge the corrugated panel for larger toilet bowls.

BRIEF DESCRIPTION OF THE SEVERAL VIEWS OF THE DRAWINGS

FIG. 7 is an upper perspective view of the splash guard of the present invention in the first configuration, with the hinged attachment on the bottom layer and with a tip portion.

FIG. 8 is a side elevation view of the splash guard of the present invention, according to FIG. 7.

FIG. 9 is a side perspective view of the splash guard of the present invention switching between the first and second configuration and showing alternative embodiments of the opening and tip portion.

FIG. 10 is a side perspective view of the splash guard of the present invention, according to FIGS. 1-3.

DETAILED DESCRIPTION OF THE INVENTION

Figure 1:
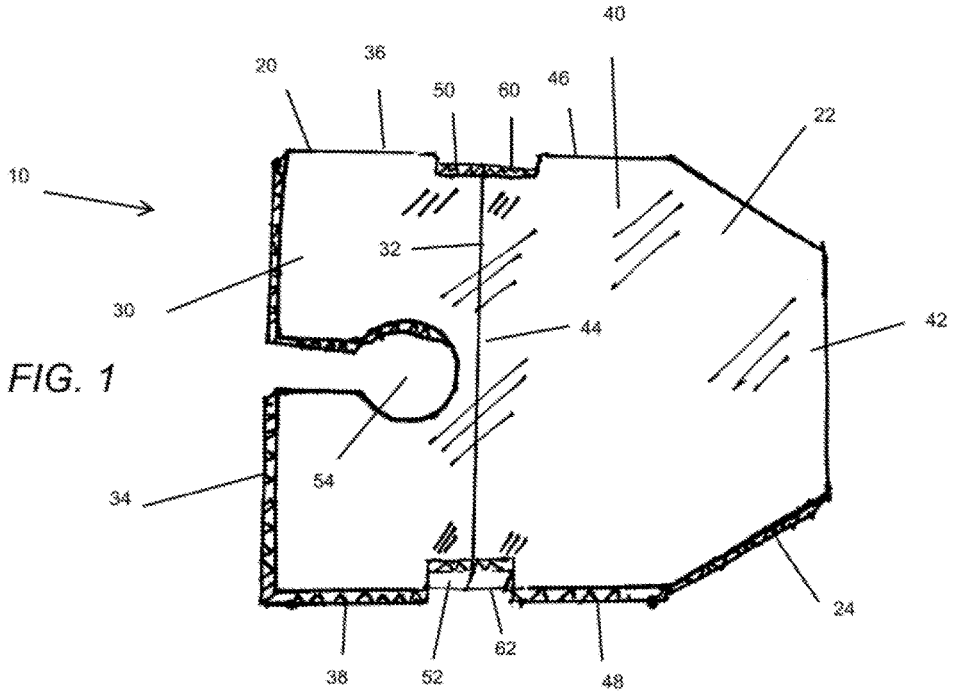
FIG. 1 is an upper perspective view of the splash guard of the present invention in the second configuration.
Figure 2:
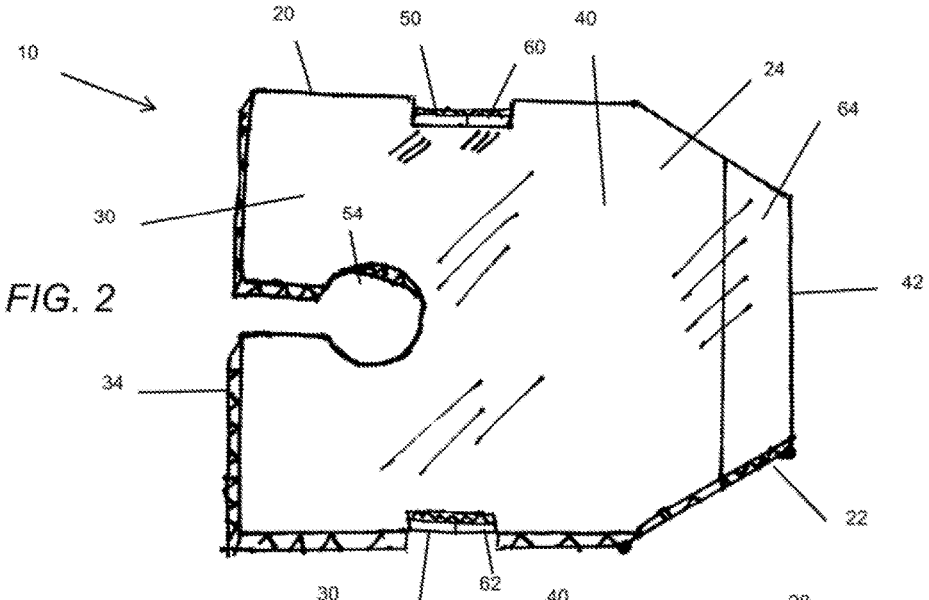
FIG. 2 is a bottom perspective view of the splash guard of the present invention in the second configuration.

Referring to FIGS. 1-10, embodiments of the splash guard have unitary construction and different configurations. For plunging a toilet, the splash guard must be easily stored and conveniently accessible for use. A condensed volume and smaller dimensions allow for easier storage and packaging; however, the splash guard must still be sufficiently large to perform the task of covering toilet bowls of various sizes. In the present invention, the splash guard 10 has unitary construction and multiple configurations, including configuration for storage and for operation.

FIGS. 1-10 show the splash guard 10 comprising a corrugated panel 20 having a top layer 22 and a bottom layer 24. The corrugated panel 20 is one piece, and the different components are attached and made integral. Various materials can be used for the corrugated panel, including paper or cardboard for disposable versions, and plastics for more durable or re-useable versions. The top layer 22 is connected to the bottom layer 24 by known means of corrugation. Any pattern of interstitial connectors between the top layer 22 and the bottom layer 24 can be covered by the present invention. The corrugation of the present invention can include a wavy thinner layer attached by adhesive or angular plastic slats bonded to the top layer 22 and the bottom layer 24.

The embodiments of the corrugated panel 20 comprise a first portion 30 having a first front side 32, a first back side 34 opposite the first front side and two first opposing sides 36, 38, and a second portion 40 having a second front side 42, a second back side 44 opposite the second front side and two second opposing sides 46, 48. The first and second portions 30, 40 can have any shape for covering a toilet bowl. The dimensions must be sufficient for the function of preventing toilet water from splashing out of the toilet bowl. The first and second portions 30, 40 are physical barriers to the toilet water.

The first portion 30 can be comprised of a plurality of first flaps 50, 52, and the second portion is comprised of a plurality of second flaps 60, 62, respectively. Each first flap 50, 52 is on a respective first opposing side 36, 38 and adjacent to the first front side 32, and each second flap 60, 62 is on a respective second opposing side 46, 48 and adjacent to the second back side 44. A first flap 50 on the left is on the first opposing side 36 on the left; a first flap 52 on the right is on the first opposing side 38 on the right; a second flap 60 on the left is on the second opposing side 46 on the left; and a second flap 62 on the right is on the second opposing side 48 on the right. "left" and "right" are only illustrative for more clear explanation and identification of relative positions. For purposes of illustration, the "left" can correspond to the left side of the toilet bowl if a person is sitting on the toilet bowl. The first and second flaps 50, 52, 60, 62 are aligned so that the position of the first flaps 50, 52 can match the position of the second flaps 60, 62, even though each first flap 50,52 is hinged to each first opposing side 36, 38 by the bottom layer 24 and each second flap 60, 62 is hinged to each second opposing side 46, 48 by the bottom layer 24. The first front side 32 of the first portion 30 is in hinged attachment to the second back side 44 of the second portion 40.

FIGS. 4-9 show the relationship between the first portion 30 and the second portion 40 in the first configuration. The first portion 30 is folded to the second portion 40 along the hinged attachment of the first front side 32 and the second back side 44, and the first flaps 50, 52 and the second flaps 60, 62 are locked in position relative to each other. The flaps 50, 52, 60, 62 cannot bend or fold in any direction and remain flush or coplanar with the respective first portion 30 and second portion 40.

When the first front side 32 of the first portion 30 is in hinged attachment to the second back side 44 of the second portion 40 by the bottom layer 24, the bottom layer 24 of the first portion 30 is adjacent the bottom layer 24 of the second portion 40 (See FIGS. 5-8). The flaps 50, 52, 60, 62 remain flush to the top layer 22 of both the first portion 30 and the second portion 40. When the first front side 32 of the first portion 30 is in hinged attachment to the second back side 44 of the second portion 40 by the top layer 22, the folding is inverted (See FIG. 4). The top layer 22 of the first portion 30 is adjacent the top layer 22 of the second portion 40. However, each flap 50, 52, 60, 62 remains flush to the respective top layer 22 of both the first portion 30 and the second portion 40 in both embodiments of the hinged attachment.

FIGS. 1-3 and 9-10 show the relationship between the first portion 30 and the second portion 40 in the second configuration. The first portion 30 is flush or co-planar with the second portion 40. The corrugated panel 20 is spread so as to cover the toilet bowl. The top layer 22 of the first portion 30 is adjacent and made continuous with the top layer 22 of the second portion 40. The bottom layer 24 of the first portion 30 is flush or co-planar with the bottom layer 24 of the second portion 40. The bottom layer 24 is similarly adjacent and made continuous across the first portion 30 to the second portion 40. The second configuration further includes each first flap 50, 52 being folded downward from the top layer 22 of the first portion 30 along the hinged attachment of a respective first opposing side 36, 38 on the bottom layer 24 and each second flap 60, 62 being folded downward from the top layer 22 of the second portion 40 along the hinged attachment of a respective second opposing side 46, 48 on the bottom layer 24. A first flap 50 on the left is on the first opposing side 36 on the left; a first flap 52 on the right is on the first opposing side 38 on the right; a second flap 60 on the left is on the second opposing side 46 on the left; and a second flap 62 on the right is on the second opposing side 48 on the right. In the second configuration, the first portion 30 is locked in position relative to the second portion 40 to be planar by the first flaps 50, 52 and the second flaps 60, 62. The flaps 50, 52, 60, 62 are aligned so that the first portion 30 is prevented from folding back against the second portion 40. The first flaps 50, 52 abut the second flaps 60, 62 so that the first portion 30 cannot move relative to the second portion 40. In some embodiments, the first flaps 50, 52 and the second flaps 50, 52 in the second configuration align with toilet bowl opening so as to fit within the toilet bowl. The shape and dimensions of the flaps 50, 52, 60, 62 can correspond to any parameters compatible with the relationship between the first portion 30 and the second portion 40 in the present invention.

Figure 3:
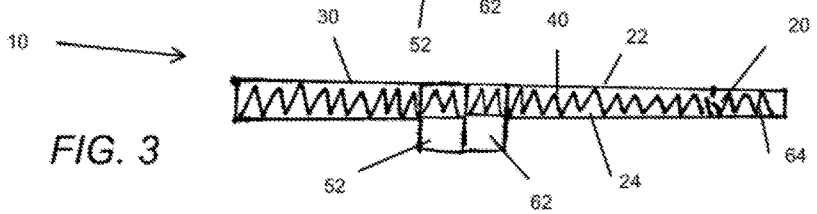
FIG. 3 is a side elevation view of the splash guard of the present invention in the second configuration.
Figure 4:
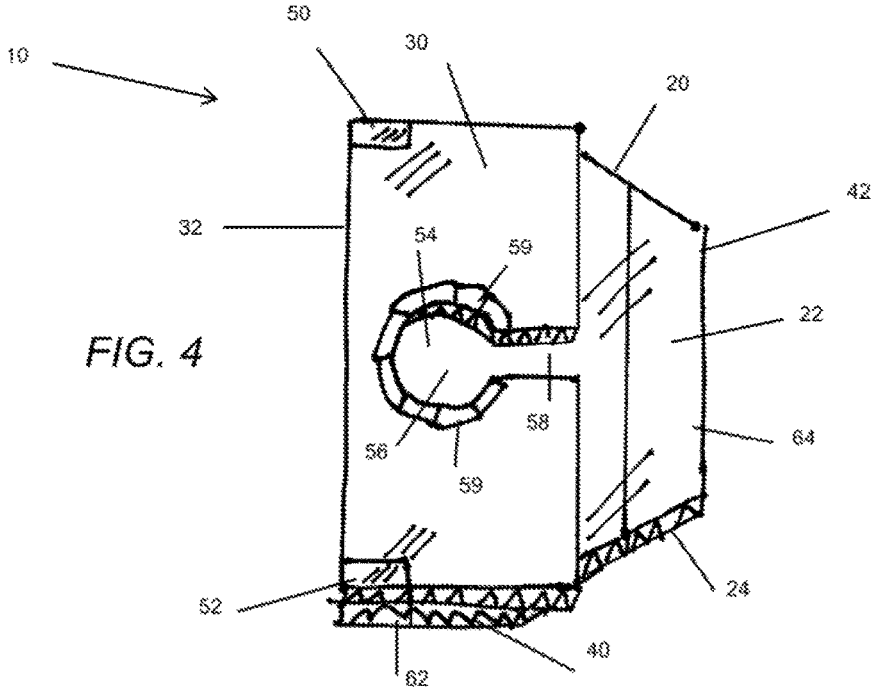
FIG. 4 is an upper perspective view of the splash guard of the present invention in the first configuration, with the hinged attachment on the top layer and the hole flaps around the opening.
Figure 5:
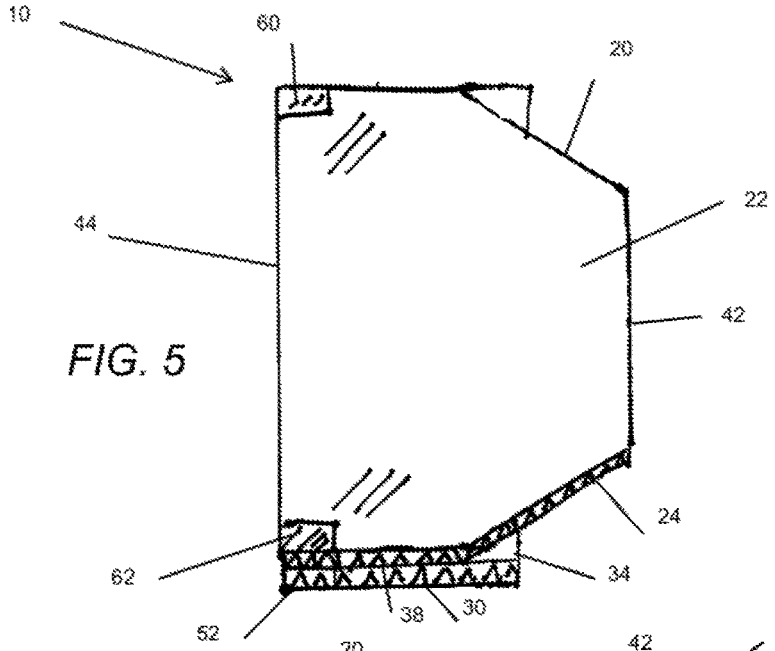
FIG. 5 is an upper perspective view of the splash guard of the present invention in the first configuration, with the hinged attachment on the bottom layer.
Figure 6:
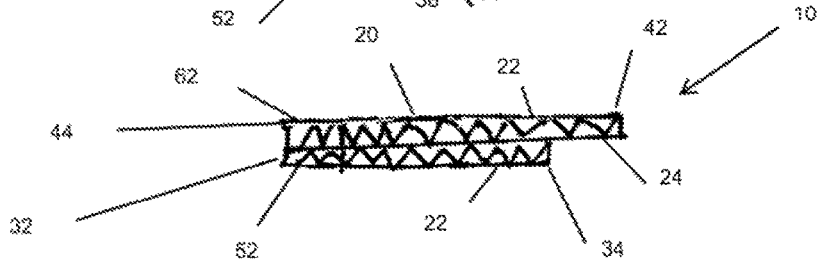
FIG. 6 is a side elevation view of the splash guard of the present invention, according to FIG. 5.

FIGS. 1-3 and 9 show the various embodiments of the opening 54 in the first portion 30. FIGS. 1-3 and 9 show embodiments with a keyhole appearance with the opening 54 extending from the first back side 34 toward the first front side 32. The opening 54 can be comprised of a centered portion 56 and an extension portion 58. In one embodiment, FIG. 3 shows that the centered portion 56 can be round and placed in the middle of the first portion 30 and have a plurality of hole flaps 59. The hole flaps 59 can be hinged around the centered portion 56 by the bottom layer 24 or the top layer 22.

Embodiments of the tip portion 64 of the second portion 40 are shown in FIGS. 2, 3, 7, and 8. The tip portion 64 can be in hinged attachment to the second front side 42. The tip portion 46 is folded to the second portion 40 along the hinged attachment to the second front side 42 by the top layer 22, when the first portion 30 and the second portion 40 are hinged at the bottom layer 24. FIGS. 7-8 show the collapsed corrugated panel 20 with the tip portion 46 folded against the second portion 40. Alternatively, the tip portion 64 is folded to the second portion 40 along the hinged attachment to the second front side 42 by the bottom layer 24, when the first portion 30 and the second portion 40 are hinged at the top layer 22 (not shown). The first configuration with the tip portion 64 is more compact.

The method of the present invention is shown through FIGS. 4 to 9 to 10. The method for plunging a toilet bowl includes assembling the corrugated panel 20 having a first portion 30 and a second portion 40 with the first and second configurations. The first flaps 50, 52 are aligned with the second flaps, 60, 62, and the first front side 32 of the first portion 30 hinges to the second back side 44 of the second portion 40. The first configuration has the first portion 30 folded to the second portion 40 along the hinged attachment of the first front side 32 and the second back side 44, and the first flaps 50, 52 and the second flaps 60, 62, are locked in position relative to each other, as in FIG. 4 or alternatively FIG. 3. The second configuration has the first portion 30 flush or co-planar with the second portion 40 in FIGS. 1-3 and 10. In the second configuration, the first flaps 50, 52 and second flaps 60 62, are folded downward from the top layer 22, such that the first portion 30 is locked in position relative to the second portion 40 by the first flaps 50, 52 and the second flaps 60, 62. FIG. 9 shows the transition before the first flaps 50, 52 and second flaps 60 62 are hinged to the second configuration.

The corrugated panel is set in the first configuration as a storage configuration. The splash guard can be stored and hidden from view, until the need for plunging arrives. The splash guard in the first configuration is compact and dimensioned to be as small as possible. Then, a plunger is set in a toilet bowl for the unclogging operation. The plunger has a handle end and a clog end for insertion into the toilet bowl. Meanwhile, the handle end extends out of the toilet bowl.

Then, the embodiments of the method include switching the corrugated panel from the first configuration to the second configuration. The first portion 30 is unfolded from the second portion 40, and the first flaps 50, 52 and the second flaps 60, 62 are folded downward. With the first portion 30 and the second portion 40 spread, the splash guard 10 reaches the shape and dimensions to cover a toilet bowl. The splash guard 10 can prevent toilet water from splashing from the toilet bowl.

In the method, the handle end inserts through the corrugated panel in the second configuration so that the plunger can be actuated through the corrugated panel so as to unclog the toilet bowl. For example, the plunger can be pumped up and down to create and exert suction force on the clog.

For embodiments with an opening 54 in the first portion as in FIG. 3, the handle end aligns with the opening. The handle end can insert through opening or can be guided through the opening. In the embodiments with the opening being a "keyhole" shape with a centered portion 56 and extension portion 58, the handle end can be guided through the extension portion 58 from the first back side to the centered portion. Furthermore, there can be hole flaps around the centered portion 56. Each hole flap hinges to the first portion from either the top layer or bottom layer, in order to enlarge the opening 54. The method can include folding each hole flap at the bottom layer to fold down. Alternatively, each hole flap can be folded up at the top layer.

For embodiments with a tip portion 64 of the second portion 40, according to FIGS. 7-8, the method includes folding the tip portion to the second portion along the hinged attachment to the second front side by the top layer or by the bottom layer for setting the first configuration. The tip portion 40 is folded in the first configuration for storing in a more compact form. Thus, the step of switching from the first configuration to the second configuration includes unfolding the tip portion from the second portion. The second configuration is enlarged for the corrugated panel to be suitable for larger toilet bowls.

The splash guard of the present invention has unitary construction and multiple configurations. The unitary construction allows the splash guard to be easily stored with all of the necessary pieces. There are no parts or attachments to lose. The splash guard also has a first configuration as the storage configuration and a second configuration as the operating configuration. When folded, the splash guard is collapsed to reduce volume and span for more compatibility with storage spaces. Additionally, the splash guard can be locked rigid in the operating configuration. The full span of the splash guard can be spread wide to be suitable for any toilet bowl. Additionally, there can be a tip portion to further expand the coverage over the toilet bowl, while still being collapsible for convenient storage. The splash guard is not floppy and weak, even though the splash guard was unfolded from a compact form. In particular, the splash guard has side flaps to set the relationship between the first and second portions of the splash guard. The interaction of the flaps locks the panel in the operating configuration. The flaps fold downward and are even suitable for aligning the splash guard on the toilet bowl.

Other features of the splash guard that have an adjustable hole or opening for passing different handles of different plungers through the splash guard. The splash guard remains rigid, as the handle of any plunger can move up and down in a pumping action without disturbing the splash guard from covering the toilet bowl. Furthermore, the readily collapsible and rigid extendable splash guard of the present invention can be made from corrugated materials having a first layer and a second layer. The portions of the panel are defined by the hinged attachments to the particular first or second layer. The splash guard enables a collapsible, yet strong and resilient panel to prevent toilet water from splashing from the toilet bowl during plunging. The splash guard promotes sanitary conditions, while unclogging a toilet.

The foregoing disclosure and description of the invention is illustrative and explanatory thereof. Various changes in the details of the illustrated structures, construction and method can be made without departing from the true spirit of the invention.

I claim:

1. A splash guard for plunging a toilet, comprising:

a corrugated panel having a top layer and a bottom layer, said corrugated panel being comprised of:

a first portion having a first front side, a first back side opposite said first front side and two first opposing sides, wherein said first portion is comprised of a plurality of first flaps, each first flap being positioned on a respective first opposing side and adjacent to said first front side, each first flap being in hinged attachment to said respective first opposing side by said bottom layer; and a second portion having a second front side, a second back side opposite said second front side and two second opposing sides, wherein said second portion is comprised of a plurality of second flaps, each second flap being positioned on a respective second opposing side and adjacent to said second back side, each second flap being in hinged attachment to said respective second opposing side by said bottom layer, wherein said plurality of first flaps are aligned with said plurality of second flaps, wherein said first front side of said first portion is in hinged attachment to said second back side of said second portion, wherein said corrugated panel has a first configuration with said first portion folded to said second portion along said hinged attachment of said first front side and said second back side, wherein said plurality of first flaps in said first configuration and said plurality of second flaps in said first configuration are locked in position relative to each other, wherein said corrugated panel has a second configuration with said first portion flush with said second portion, said top layer of said first portion being planar with said top layer of said second portion in said second configuration, said bottom layer of said first portion being planar with said bottom layer of said second portion in said second configuration, wherein each first flap is folded downward from said top layer of said first portion along said hinged attachment of said respective first opposing side on said bottom layer in said second configuration, wherein each second flap is folded downward from said top layer of said second portion along said hinged attachment of said respective second opposing side on said bottom layer in said second configuration, and wherein said first portion is locked in position relative to said second portion by said plurality of first flaps and said second flaps in said plurality of second configuration.

2. The splash guard, according to claim 1, wherein said first front side of said first portion is in hinged attachment to said second back side of said second portion by said bottom layer, said bottom layer of said first portion being adjacent said bottom layer of said second portion in said first configuration, each first flap being flush with said top layer of said first portion in said first configuration, each second flap being flush with said top layer of said second portion in said first configuration.

3. The splash guard, according to claim 1, wherein said first front side of said first portion is in hinged attachment to said second back side of said second portion by said top layer, said top layer of said first portion being adjacent said top layer of said second portion in said first configuration, each first flap being flush with said top layer of said first portion in said first configuration, each second flap being flush with said top layer of said second portion in said first configuration.

4. The splash guard, according to claim 1, wherein said first portion is comprised of an opening extending from said first back side toward said first front side.

5. The splash guard, according to claim 4, wherein said opening is comprised of a centered portion and an extension portion, said centered portion having a plurality of hole flaps around said centered portion.

6. The splash guard, according to claim 1, wherein said second portion is comprised of a tip portion in hinged attachment to said second front side.

7. The splash guard, according to claim 6, wherein said first front side of said first portion is in hinged attachment to said second back side of said second portion by said bottom layer, said bottom layer of said first portion being adjacent said bottom layer of said second portion in said first configuration, each first flap being flush with said top layer of said first portion in said first configuration, each second flap being flush with said top layer of said second portion in said first configuration, and wherein said tip portion is folded to said second portion along said hinged attachment to said second front side by said top layer.

8. The splash guard, according to claim 6, wherein said first front side of said first portion is in hinged attachment to said second back side of said second portion by said top layer, said top layer of said first portion being adjacent said top layer of said second portion in said first configuration, each first flap being flush with said top layer of said first portion in said first configuration, each second flap being flush with said top layer of said second portion in said first configuration, and wherein said tip portion is folded to said second portion along said hinged attachment to said second front side by said bottom layer.

9. A method for plunging a toilet bowl, the method comprising the steps of:

assembling a corrugated panel having a top layer and a bottom layer, said corrugated panel being comprised of:

a first portion having a first front side, a first back side opposite said first front side and two first opposing sides, wherein said first portion is comprised of a plurality of first flaps, each first flap being positioned on a respective first opposing side and adjacent to said first front side, each first flap being in hinged attachment to said respective first opposing side by said bottom layer; and a second portion having a second front side, a second back side opposite said second front side and two second opposing sides, wherein said second portion is comprised of a plurality of second flaps, each second flap being positioned on a respective second opposing side and adjacent to said second back side, each second flap being in hinged attachment to said respective second opposing side by said bottom layer, wherein said plurality of first flaps are aligned with said plurality of second flaps, wherein said first front side of said first portion is in hinged attachment to said second back side of said second portion, wherein said corrugated panel has a first configuration with said first portion folded to said second portion along said hinged attachment of said first front side and said second back side, wherein said plurality of first flaps in said first configuration and said plurality of second flaps in said first configuration have been locked in position relative to each other wherein said corrugated panel has a second configuration with said first portion flush with said second portion, said top layer of said first portion being planar with said top layer of said second portion in said second configuration, said bottom layer of said first portion being planar with said bottom layer of said second portion in said second configuration, wherein each first flap is folded downward from said top layer of said first portion along said hinged attachment of said respective first opposing side on said bottom layer in said second configuration, wherein each second flap is folded downward from said top layer of said second portion along said hinged attachment of said respective second opposing side on said bottom layer in said second configuration, wherein said first portion is locked in position relative to said second portion by said plurality of first flaps and said plurality of second flaps in said second configuration;

setting said corrugated panel in said first configuration so as to be stored;

setting a plunger in a toilet bowl, said plunger having a handle end and a clog end, said clog end being inserted into said toilet bowl, said handle end extending out of said toilet bowl;

switching said corrugated panel from said first configuration to said second configuration;

inserting said handle end through said corrugated panel in said second configuration; and actuating said plunger through said corrugated panel so as to plunge said toilet bowl.

10. The method for plunging a toilet bowl, according to claim 9, wherein said first portion is comprised of an opening 5'1 extending from said first back side toward said first front side, wherein the step of inserting said handle end comprises the step of:

aligning said handle end with said opening.

11. The method for plunging a toilet bowl, according to claim 10, wherein said opening is comprised of a centered portion and an extension portion, said centered portion having a plurality of hole flaps around said centered portion, each hole flap being in hinged attachment to said first portion by said bottom layer, and wherein the step of inserting said handle end comprises the step of:

folding each hole flap at said bottom layer so as to enlarge said opening.

12. The method for plunging a toilet bowl, according to claim 10, wherein said opening is comprised of a centered portion and an extension portion, said centered portion having a plurality of hole flaps around said centered portion, each hole flap being in hinged attachment to said first portion by said top layer, and wherein the step of inserting said handle end comprises the step of:

folding each hole flap at said top layer so as to enlarge said opening.

13. The method for plunging a toilet bowl, according to claim 9, wherein said second portion is comprised of a tip portion in hinged attachment to said second front side, and wherein the step of setting said corrugated panel in said first configuration comprises the step of:

folding said tip portion to said second portion along said hinged attachment to said second front side by said top layer.

14. The method for plunging a toilet bowl, according to claim 9, wherein said second portion is comprised of a tip portion in hinged attachment to said second front side, and wherein the step of setting said corrugated panel in said first configuration comprises the step of:

folding said tip portion to said second portion along said hinged attachment to said second front side by said bottom layer.

15. The method for plunging a toilet bowl, according to claim 9, wherein said first front side of said first portion is in hinged attachment to said second back side of said second portion by said bottom layer, said bottom layer of said first portion being adjacent said bottom layer of said second portion in said first configuration, each first flap being flush with said top layer of said first portion in said first configuration, each second flap being flush with said top layer of said second portion in said first configuration.

* * * * *